United States Patent [19]

Wang

[11] Patent Number: 4,865,327

[45] Date of Patent: Sep. 12, 1989

[54] BOARD GAME

[76] Inventor: Kuo-Yi Wang, 41 Division Ave., Summit, N.J. 07901

[21] Appl. No.: 136,781

[22] Filed: Dec. 22, 1987

[51] Int. Cl.[4] ..... A63F 3/00

[52] U.S. Cl. ..... 273/257

[58] Field of Search ..... 273/242, 243, 248, 249, 273/257, 268, 279, 241

[56] References Cited

U.S. PATENT DOCUMENTS

| | | | |
|---|---|---|---|
| 352,116 | 11/1886 | Bush | 273/241 |
| 398,233 | 2/1889 | Clarke | 273/279 |
| 1,143,210 | 6/1915 | Liljencrantz | 273/257 |
| 1,224,173 | 5/1917 | Kajiyama | 273/249 |
| 1,536,672 | 5/1925 | Hobbs | 273/249 |
| 1,907,255 | 5/1933 | Ferrari, Jr. | 273/279 |
| 2,745,667 | 5/1956 | Graham et al. | 273/243 |
| 3,033,572 | 5/1962 | Thibault | 273/243 |
| 3,567,226 | 12/1968 | Matthews | 273/248 |
| 3,603,593 | 9/1971 | Chew | 273/161 |
| 3,977,680 | 8/1976 | Lavine | 273/249 |
| 4,095,799 | 6/1978 | Stringer | 273/241 |
| 4,299,390 | 11/1981 | Delgado | 273/257 |

*Primary Examiner*—Edward M. Coven
*Assistant Examiner*—William E. Stoll
*Attorney, Agent, or Firm*—Beveridge, DeGrandi & Weilacher

[57] ABSTRACT

A board game in which players attempt to become President of the United States by accumulating the required amount of electoral votes. Each player has a first game piece to be used in one or more "non-special" sections and a second game piece to be used in a single "special" section. Within the non-special sections are space indicators which direct the one piece to various areas exclusively within the non-special section or sections. A few of the space indicators within the non-special sections indicate when the second playing piece is to be used exclusively within the special section. Within the special section are also space indicators which indicate various moves to be taken by the first playing piece positioned in the non-special sections. Also within the special section are space indicators which are for the accumulation of electoral votes or the accumulation of monetary value chips.

15 Claims, 23 Drawing Sheets

52

| B | EDUCATION | | | | | |
|---|---|---|---|---|---|---|
| 1 Ph.D. | C1 | C2 | C3 | C4 | STAY | B2 |
| 2 Master Degree | C2 | C3 | C4 | B1 | STAY | B3 |
| 3 Bachelor of Arts | C3 | C4 | B1 | B2 | STAY | B3 |
| 4 2 Years College | C4 | B1 | B2 | B3 | STAY | B5 |
| 5 Senior High School | B1 | B2 | C5 | C6 | STAY | B6 |
| 6 Junior High School | B2 | B3 | B4 | B5 | STAY | B7 |
| 7 Elementary School | B3 | B4 | B5 | B6 | STAY | B8 |
| 8 Kindergarten | B4 | B5 | B6 | B7 | STAY | A |
| A START | B5 | B6 | B7 | B8 | STAY | STAY |

48

Fig. 4.

52

| B | EDUCATION | | | | | | |
|---|---|---|---|---|---|---|---|
| 1 | Ph.D. | C1 | C2 | C3 | C4 | STAY | B2 |
| 2 | Master Degree | C2 | C3 | C4 | B1 | STAY | B3 |
| 3 | Bachelor of Arts | C3 | C4 | B1 | B2 | STAY | B3 |
| 4 | 2 Years College | C4 | B1 | B2 | B3 | STAY | B5 |
| 5 | Senior High School | B1 | B2 | C5 | C6 | STAY | B6 |
| 6 | Junior High School | B2 | B3 | B4 | B5 | STAY | B7 |
| 7 | Elementary School | B3 | B4 | B5 | B6 | STAY | B8 |
| 8 | Kindergarten | B4 | B5 | B6 | B7 | STAY | A |
| A | START | B5 | B6 | B7 | B8 | STAY | STAY |
| | | ⋮ | ⋮ | ⋮ | ⋮ | ⋮ | ⋮ |

48

Fig. 5.

| C | ASSIGNMENT | | | | | |
|---|---|---|---|---|---|---|
| 1 | D16 | O9 | D17 | P17 | O16 | S5 |
| 2 | P19 | F12 | O14 | S13 | R6 | R7 |
| 3 | N9 | N7 | N13 | N15 | S14 | O18 |
| 4 | E21 | N11 | N14 | N16 | K15 | F15 |
| 5 | E22 | I11 | N17 | L10 | S16 | K16 |
| 6 | S16 | I11 | L10 | R13 | N17 | R14 |

Fig. 6.

54

| D | THE WHITE HOUSE OFFICE | | | | | | |
|---|---|---|---|---|---|---|---|
| 1 | Chief of Staff | W2 | W2 | W10 | H1 | G2 | RETIRE |
| 2 | National Security Adviser | P1 | E1 | W4 | I3 | Q3 | N1 |
| 3 | Special Assistant to the President | O1 | W4 | W10 | O2 | Q11 | K4 |
| 4 | Assistant to the President | E1 | H2 | W10 | W13 | H4 | H6 |
| 5 | Deputy Assistant to the President | P2 | O3 | W10 | E4 | E5 | O6 |
| 6 | Press Secretary | T2 | T3 | W10 | T4 | H13 | T6 |
| 7 | Executive Assistant | H8 | P3 | W9 | M15 | D13 | M9 |
| 8 | Counsel | O1 | H2 | Q2 | P5 | M11 | H12 |
| 9 | Deputy Counsel | P2 | H3 | D8 | H9 | T6 | M14 |
| 10 | Assistant Counsel | D9 | S2 | M11 | G9 | O13 | P19 |
| 11 | Physician of the President | I3 | D3 | W10 | N1 | R3 | R4 |
| 12 | Director | Q13 | Q18 | W9 | Q8 | D10 | D14 |
| 13 | Associate Director | Q5 | Q6 | D12 | E11 | O12 | D15 |
| 14 | Deputy Associate Director | D13 | M6 | W9 | H13 | N6 | V8 |
| 15 | Assistant Director | M6 | F7 | W9 | D14 | D18 | W12 |
| 16 | Administrator | H12 | D6 | W9 | D7 | T9 | O12 |
| 17 | Senior Staff | M16 | P13 | W9 | W13 | N5 | H15 |
| 18 | Junior Staff | F13 | D14 | W9 | D15 | G12 | W12 |
| 19 | Security Guard | G12 | P21 | S14 | J9 | J10 | R13 |

Fig. 7.

| E | OTHER FEDERAL GOVERNMENT DEPARTMENTS | | | | | | |
|---|---|---|---|---|---|---|---|
| 1 | Secretary | D1 | G1 | U1 | O1 | V1 | RETIRE |
| 2 | Deputy Secretary | E1 | P1 | W5 | V1 | Q9 | Q10 |
| 3 | Chief of Staff | E2 | I3 | D4 | H18 | H6 | J1 |
| 4 | Assistant Secretary | O3 | P6 | D4 | W13 | M13 | E5 |
| 5 | Deputy Assistant Secretary | O5 | P9 | E4 | M16 | S5 | O16 |
| 6 | Special Assistant | Q4 | U6 | W9 | S2 | S10 | H14 |
| 7 | Inspector General | P2 | H7 | O7 | P11 | M7 | E12 |
| 8 | Comptroller | Q13 | P7 | Q3 | E4 | P16 | W11 |
| 9 | General Counsel | D8 | G3 | O7 | P12 | E14 | U9 |
| 10 | Solicitor | O7 | H8 | P2 | O10 | O13 | G6 |
| 11 | Treasurer | U3 | D7 | V3 | P10 | M9 | W11 |
| 12 | Deputy Inspector General | P11 | Q15 | O8 | S10 | H14 | L7 |
| 13 | Deputy Comptroller | P9 | M10 | E8 | S10 | P19 | M14 |
| 14 | Deputy General Counsel | M11 | E9 | U5 | F10 | U17 | L6 |
| 15 | Deputy Solicitor | G9 | P12 | H10 | I6 | I7 | V10 |
| 16 | Deputy Treasurer | U8 | F10 | M13 | V7 | M17 | L8 |
| 17 | Assistant to the Secretary | F8 | M13 | E14 | F12 | S13 | M19 |
| 18 | Director | Q19 | Q7 | Q10 | Q11 | E17 | H14 |
| 19 | Deputy Director | H13 | T5 | D16 | T9 | I4 | V9 |
| 20 | Senior Staff | P17 | O12 | D15 | T11 | P21 | W12 |
| 21 | Junior Staff | O17 | N12 | F14 | N13 | N14 | N16 |
| 22 | Security Guard | N10 | R10 | U14 | J9 | R14 | U16 |

Fig. 8.

| F | THE HOUSE OF REPRESENTATIVES | | | | | | |
|---|---|---|---|---|---|---|---|
| 1 | The Speaker | W2 | W2 | W13 | W10 | G2 | RETIRE |
| 2 | Majority Leader | W2 | W13 | W10 | F1 | P1 | RETIRE |
| 3 | Minority Leader | W2 | W13 | W10 | F2 | G2 | RETIRE |
| 4 | Majority Whip | W3 | F1 | F2 | F3 | Q4 | RETIRE |
| 5 | Minority Whip | W3 | F2 | F3 | F4 | Q3 | RETIRE |
| 6 | House Representative | W6 | F3 | F4 | F5 | Q9 | RETIRE |
| 7 | Clerk | M15 | D12 | O10 | E13 | G10 | W11 |
| 8 | Sergeant at Arms | Q15 | U7 | O15 | W13 | R2 | J4 |
| 9 | Director | Q2 | Q4 | Q18 | P15 | E15 | R1 |
| 10 | Deputy Director | Q5 | G7 | W10 | G8 | P19 | I4 |
| 11 | Chaplain | N3 | S5 | E17 | K11 | U14 | L8 |
| 12 | Post Master | P16 | F7 | T8 | T10 | V11 | T11 |
| 13 | Senior Staff | O11 | M16 | D10 | U13 | H15 | W12 |
| 14 | Junior Staff | M8 | P17 | U9 | I8 | P21 | W12 |
| 15 | Security Guard | G12 | J7 | O18 | M20 | I11 | K16 |

Fig. 9.

90

| G | JUDICIAL BRANCH | | | | | | |
|---|---|---|---|---|---|---|---|
| 1 | Chief Justice | W2 | W2 | W13 | T1 | G2 | RETIRE |
| 2 | Associate Justice | D1 | U1 | I1 | T1 | O3 | RETIRE |
| 3 | Judge, Circuit Court | W3 | W4 | H2 | W13 | G9 | S4 |
| 4 | Judge, District Count | W4 | H2 | G2 | G3 | O15 | W11 |
| 5 | Reporter of Decisions | D6 | H11 | M6 | W13 | G10 | G11 |
| 6 | Librarian | M11 | H5 | P15 | F8 | U9 | V7 |
| 7 | Director | O4 | Q4 | Q13 | Q18 | M13 | W12 |
| 8 | Deputy Director | Q16 | Q3 | Q10 | F8 | M14 | J6 |
| 9 | General Counsel | D8 | O7 | G3 | H9 | S4 | E14 |
| 10 | Senior Staff | M7 | O11 | H13 | W13 | N4 | J5 |
| 11 | Junior Staff | M9 | E16 | M14 | V9 | G12 | J8 |
| 12 | Marshal | O14 | H15 | F14 | E21 | J8 | L9 |

Fig. 10.

| H | DEPARTMENT OF STATE | | | | | | |
|---|---|---|---|---|---|---|---|
| 1 | Secretary | W2 | W2 | W13 | W10 | I1 | RETIRE |
| 2 | Deputy Secretary | H1 | G1 | I1 | T1 | D2 | H17 |
| 3 | Under Secretary | W4 | H2 | L1 | H17 | U10 | E3 |
| 4 | Assistant Secretary | H17 | O2 | H3 | Q1 | O6 | D10 |
| 5 | Special Assistant | P3 | O7 | W9 | Q1 | M12 | S3 |
| 6 | Chief of Protocol | Q1 | Q14 | W10 | G5 | O12 | W12 |
| 7 | Inspector General | H2 | W5 | W9 | D3 | Q11 | M6 |
| 8 | Comptroller | H2 | W4 | W5 | W6 | E10 | W11 |
| 9 | Counselor | P6 | H3 | G4 | H18 | G6 | H14 |
| 10 | Legal Adviser | O7 | P5 | V1 | Q9 | E15 | O13 |
| 11 | Spokesman | T3 | U6 | W9 | Q6 | G5 | T8 |
| 12 | Director | H3 | D4 | G3 | D12 | E18 | D16 |
| 13 | Deputy Director | H12 | P8 | H18 | W13 | H14 | L5 |
| 14 | Senior Staff | I6 | E18 | W9 | E13 | M17 | I8 |
| 15 | Junior Staff | E16 | P19 | W9 | D18 | N10 | W12 |
| 16 | Security Guard | O18 | G12 | I9 | L9 | R14 | U16 |
| 17 | U.S. Representative to the United Nations | H2 | P1 | G2 | E2 | H18 | O5 |
| 18 | Ambassador | H3 | H17 | P3 | H4 | H6 | P18 |

Fig. 11.

| I | UNIVERSITY ADMINISTRATION | | | | | | |
|---|---|---|---|---|---|---|---|
| 1 | Chairman, Board of Trustee | W2 | W13 | W10 | T1 | H2 | V1 |
| 2 | President | W2 | W13 | W10 | U1 | W6 | W5 |
| 3 | Vice President | W4 | W5 | P1 | P2 | I5 | R3 |
| 4 | Assistant to the President | S12 | L5 | W13 | S13 | N8 | I9 |
| 5 | Dean | I3 | U4 | P5 | H12 | P18 | R4 |
| 6 | Associate Dean | I5 | N1 | O15 | R1 | G10 | W12 |
| 7 | Assistant Dean | I6 | N2 | U8 | S11 | R7 | R8 |
| 8 | Division Director | S12 | R5 | U13 | R9 | N10 | R10 |
| 9 | Senior Staff | N5 | S13 | U10 | R10 | R11 | R12 |
| 10 | Junior Staff | N8 | G12 | U14 | L8 | L10 | R13 |
| 11 | Security Guard | M20 | D19 | V12 | J10 | B4 | W11 |
| | | ⋮ | ⋮ | ⋮ | ⋮ | ⋮ | ⋮ |

48 50

Fig. 12.

| J | STATE POLICE | | | | | | |
|---|---|---|---|---|---|---|---|
| 1 | Superintendent | Q14 | Q15 | Q16 | S2 | J2 | D14 |
| 2 | Deputy Superintendent | J1 | W7 | S3 | S4 | D18 | J4 |
| 3 | Chief Inspector | M12 | D10 | G6 | M16 | F14 | J5 |
| 4 | Deputy Chief Inspector | W8 | D17 | M18 | J3 | K10 | E21 |
| 5 | Major | S11 | M18 | G10 | J4 | G12 | J7 |
| 6 | Captain | V10 | K9 | O16 | T10 | J7 | J8 |
| 7 | Lieutenant | J5 | J6 | O17 | K11 | V12 | R11 |
| 8 | Sergeant | J7 | K13 | K14 | I10 | I11 | W12 |
| 9 | Detective | K12 | K13 | N10 | R10 | U16 | N17 |
| 10 | Police Office | J8 | J9 | L9 | U15 | V13 | W11 |
| | | ⋮ | ⋮ | ⋮ | ⋮ | ⋮ | ⋮ |

48 50

Fig. 13.

| K | MILITARY (REPRESENTED BY ARMY) | | | | | | |
|---|---|---|---|---|---|---|---|
| 1 | Marshal | W2 | W2 | W13 | D1 | I2 | RETIRE |
| 2 | General | K1 | D1 | I1 | P4 | D2 | K3 |
| 3 | Lieutenant General | K2 | P1 | H2 | Q4 | Q19 | K4 |
| 4 | Major General | K3 | Q13 | Q4 | Q17 | U8 | K5 |
| 5 | Brigadier General | K4 | P14 | Q17 | Q15 | K6 | K7 |
| 6 | Colonel | P14 | Q14 | Q9 | K5 | K7 | J2 |
| 7 | Lieutenant Colonel | P15 | M15 | E6 | K6 | J3 | K8 |
| 8 | Major | P18 | K7 | M7 | W13 | K9 | J5 |
| 9 | Captain | K7 | P16 | V6 | K8 | F11 | K10 |
| 10 | First Lieutenant | K8 | J3 | K9 | J4 | K11 | K12 |
| 11 | Lieutenant | K9 | G10 | U17 | J5 | K12 | K13 |
| 12 | Sergeant Major | K10 | K11 | W9 | J6 | K13 | K14 |
| 13 | Sergeant, First Class | K11 | H15 | J7 | K12 | K14 | K15 |
| 14 | Sergeant | O17 | M19 | W9 | K13 | K15 | K16 |
| 15 | Corporal | K12 | K13 | K14 | J8 | K16 | W12 |
| 16 | Private | K15 | H16 | W9 | J9 | B5 | W11 |

Fig. 14.

| L | CORPORATIONS | | | | | | |
|---|---|---|---|---|---|---|---|
| 1 | Chairman | U1 | T1 | I2 | W6 | Q2 | Q19 |
| 2 | Vice Chairman | H7 | T2 | P5 | S2 | G6 | T8 |
| 3 | President | T2 | O7 | U2 | Q19 | H6 | O13 |
| 4 | Vice President | L3 | T4 | V5 | U11 | G10 | E17 |
| 5 | Director | L4 | D16 | E13 | W8 | D18 | V11 |
| 6 | Counsel | E14 | W7 | S3 | S4 | W8 | W11 |
| 7 | Division Chief | L5 | L6 | F13 | E17 | L8 | W12 |
| 8 | Senior Staff | L7 | E20 | I4 | P21 | S15 | R12 |
| 9 | Junior Staff | N7 | N8 | S14 | S15 | B1 | W12 |
| 10 | Security Guard | E22 | H16 | M20 | D19 | B4 | B5 |

Fig. 15.

| M | THE SENATE | | | | | | |
|---|---|---|---|---|---|---|---|
| 1 | President (Vice President of U.S.A.) | W2 | W2 | W2 | W13 | W6 | RETIRE |
| 2 | President of the Senate, pro tempore | W2 | W13 | W10 | T1 | W6 | RETIRE |
| 3 | Majority Leader | W2 | W13 | W10 | I1 | W6 | RETIRE |
| 4 | Minority Leader | W2 | W13 | W10 | I1 | L1 | RETIRE |
| 5 | Senator | W2 | W13 | W10 | U1 | G2 | RETIRE |
| 6 | Majority Secretary | G7 | D5 | P15 | E15 | E16 | F13 |
| 7 | Minority Secretary | H8 | M11 | E9 | S10 | V7 | S12 |
| 8 | Assistant Majority Secretary | O11 | F10 | G8 | E16 | N12 | N13 |
| 9 | Assistant Minority Secretary | P13 | E13 | M7 | D15 | L7 | U14 |
| 10 | Comptroller General | O2 | P3 | E2 | Q1 | O9 | W11 |
| 11 | Counsel | D8 | H7 | P7 | H9 | S10 | G6 |
| 12 | Sergeant at Arms | Q16 | F9 | E10 | W13 | E19 | J3 |
| 13 | Deputy Comptroller General | Q8 | H10 | P9 | S10 | M18 | F13 |
| 14 | Assistant Comptroller General | E11 | M13 | G5 | U17 | F14 | F11 |
| 15 | Director | P2 | D4 | G4 | Q6 | F7 | P18 |
| 16 | Deputy Director | W7 | H5 | Q3 | F8 | D17 | S12 |
| 17 | Chaplain | N3 | L6 | V7 | N12 | N15 | W12 |
| 18 | Senior Staff | H13 | O9 | E12 | D14 | N9 | M19 |
| 19 | Junior Staff | E17 | M14 | O16 | G11 | R10 | W12 |
| 20 | Security Guard | O18 | J7 | E21 | S15 | R14 | J10 |

Fig. 16.

| N | SCHOOL FACULTIES | | | | | | |
|---|---|---|---|---|---|---|---|
| 1 | University Professor | D2 | U6 | G4 | D6 | L4 | P10 |
| 2 | Associate Professor | I5 | T7 | Q11 | I6 | R2 | R5 |
| 3 | Assistant Professor | N2 | U12 | I6 | U17 | R8 | R9 |
| 4 | Instructor | N3 | S5 | M8 | T11 | N13 | N15 |
| 5 | Lecturer | S11 | M9 | V10 | L7 | N7 | P21 |
| 6 | Principal, Senior High School | M8 | L6 | W8 | U10 | N7 | W11 |
| 7 | Assistant Principal Senior High School | O14 | L7 | N6 | E21 | S15 | N11 |
| 8 | Teacher, Senior High School | I8 | N6 | R9 | G12 | S15 | N11 |
| 9 | Principal, Junior High School | S5 | R2 | W8 | N4 | L8 | W12 |
| 10 | Assistant Principal, Junior High School | O14 | N4 | N5 | I9 | N14 | I11 |
| 11 | Teacher, Junior High School | I9 | N13 | N15 | U15 | B2 | N17 |
| 12 | Principal, Elementary School | L6 | U13 | W8 | I4 | N10 | W11 |
| 13 | Assistant Principal, Elementary School | L7 | V11 | I8 | W13 | N14 | N16 |
| 14 | Teacher, Elementary School | N10 | O18 | N13 | N11 | B1 | B2 |
| 15 | Principal, Kindergarten | N9 | S13 | R7 | N12 | B2 | W11 |
| 16 | Teacher, Kindergarten | N13 | S14 | N15 | N14 | B2 | W12 |
| 17 | Security Guard | F15 | J8 | J9 | L10 | B4 | B5 |

Fig. 17.

| O | SCHOOL FACULTIES | | | | | | |
|---|---|---|---|---|---|---|---|
| 1 | Attorney General | D1 | G1 | T1 | W6 | O2 | RETIRE |
| 2 | Deputy Attorney General | P1 | O1 | W3 | D3 | Q12 | V2 |
| 3 | Associate Deputy Attorney General | H2 | O2 | W5 | U2 | D5 | O5 |
| 4 | Chief of Staff | W4 | E1 | L1 | H7 | Q12 | O6 |
| 5 | Assistant Secretary | H7 | P7 | D4 | G7 | D10 | S12 |
| 6 | Deputy Assistant Attorney General | H4 | Q7 | D5 | P10 | O16 | S11 |
| 7 | Solicitor General | E1 | G2 | W6 | Q2 | O10 | G9 |
| 8 | Special Assistant | U2 | Q18 | W9 | P15 | S10 | L4 |
| 9 | Assistant to the Attorney General | M10 | E6 | U5 | W13 | I7 | U13 |
| 10 | General Counsel | O3 | O4 | H17 | E7 | U12 | V6 |
| 11 | Director | Q14 | Q12 | Q15 | Q16 | J2 | J3 |
| 12 | Deputy Director | O11 | E5 | P13 | E16 | T11 | J7 |
| 13 | Deputy General Counsel | P12 | M11 | G7 | V4 | U9 | V8 |
| 14 | Associate Director | O12 | H14 | M9 | T9 | N8 | W12 |
| 15 | U.S. Attorney | G3 | H8 | U4 | D12 | G8 | W11 |
| 16 | Senior Staff | F7 | N2 | G5 | T9 | N9 | M17 |
| 17 | Junior Staff | F12 | D17 | M18 | H15 | O18 | R10 |
| 18 | U.S. Marshal | J6 | V11 | U10 | J7 | P22 | E22 |

Fig. 18.

| P | DEPARTMENT OF DEFENSE | | | | | | |
|---|---|---|---|---|---|---|---|
| 1 | Secretary | H1 | G1 | I1 | W6 | V1 | RETIRE |
| 2 | Deputy Secretary | O1 | W4 | W5 | Q2 | M10 | D5 |
| 3 | Under Secretary | W3 | L1 | P5 | V1 | D9 | E5 |
| 4 | Chairman, Joint Chiefs of Staff | D1 | K1 | I2 | K2 | D2 | RETIRE |
| 5 | Secretary of the Army | W4 | W5 | W9 | U4 | L3 | D13 |
| 6 | Secretary of the Navy | W4 | W5 | W9 | Q4 | H10 | G5 |
| 7 | Secretary of the Air Force | W4 | W5 | W9 | E2 | U5 | L3 |
| 8 | Executive Secretary | T3 | F9 | W10 | U11 | M12 | R2 |
| 9 | Assistant Secretary | H3 | E2 | O3 | T4 | E12 | P10 |
| 10 | Deputy Assistant Secretary | E3 | P8 | D9 | I6 | I7 | O14 |
| 11 | Inspector General | E2 | P6 | H17 | Q5 | D13 | W11 |
| 12 | General Counsel | D8 | P7 | Q13 | H9 | E11 | M12 |
| 13 | Director | Q17 | H5 | Q8 | Q5 | P17 | K8 |
| 14 | Secretary of Defense Representative | P5 | D4 | Q18 | K4 | K6 | P18 |
| 15 | Special Assistant | D4 | H7 | P6 | K4 | K5 | K6 |
| 16 | Deputy Inspector General | Q17 | Q19 | D5 | E18 | P19 | F11 |
| 17 | Deputy Director | P13 | E18 | F10 | M8 | M17 | K10 |
| 18 | Military Assistant | P14 | K4 | P15 | K5 | K8 | K9 |
| 19 | Assistant Inspector General | D13 | P16 | H13 | T6 | I4 | P20 |
| 20 | Senior Staff | D14 | F12 | S5 | R6 | I9 | K12 |
| 21 | Junior Staff | G11 | I8 | O17 | F11 | T12 | K15 |
| 22 | Security Guard | G12 | S14 | K14 | L9 | U16 | S16 |
| | | ⋮ | ⋮ | ⋮ | ⋮ | ⋮ | ⋮ |

Fig. 19.

| Q | HEADS OF VARIOUS INSTITUTIONS | | | | | | |
|---|---|---|---|---|---|---|---|
| 1 | F.D.A. Commissioner | I3 | P7 | D3 | I5 | G6 | R3 |
| 2 | U.S. Customs Service, Commissioner | W4 | W5 | E1 | G2 | E8 | H6 |
| 3 | I.R.S. Commissioner | Q2 | Q18 | V1 | L2 | S4 | P10 |
| 4 | U.S. Coast Guard, Commissioner | P4 | W5 | K2 | K3 | E4 | K5 |
| 5 | Federal Highway Admin., Administrator | G4 | Q13 | P2 | E6 | M6 | P13 |
| 6 | Federal Railroad Admin., Administrator | G3 | D2 | H8 | H5 | M7 | P16 |
| 7 | Federal Aviation Admin., Administrator | D4 | U2 | U4 | E9 | M12 | O6 |
| 8 | National Aeronautics & Space, Administrator | D8 | P3 | U6 | E10 | F8 | O13 |
| 9 | E.P.A. Administrator | H3 | V1 | O7 | U11 | F10 | E5 |
| 10 | N.I.H. Director | I3 | O3 | H3 | N1 | G6 | E11 |
| 11 | C.D.C. Director | H7 | P3 | Q13 | Q19 | M16 | G5 |
| 12 | Immigr. & Natural Service Commissioner | O2 | O3 | P5 | O4 | O11 | E15 |
| 13 | C.I.A. Director | W3 | O1 | W4 | D2 | Q1 | Q9 |
| 14 | F.B.I. Director | P2 | O7 | G4 | P3 | G8 | J1 |
| 15 | U.S. Marshal Service, Director | P6 | H8 | H17 | P8 | W7 | W8 |
| 16 | Bureau of Prison, Director | O4 | P7 | O4 | O8 | W7 | W8 |
| 17 | Veterans Admin., Administrator | G3 | P7 | K3 | P11 | W7 | K6 |
| 18 | U.S. Postal Service, Chairman | W5 | G2 | L1 | O3 | Q6 | E12 |
| 19 | U.S. Postal Service, Postmaster General | L1 | H17 | O4 | Q9 | W7 | W8 |
| | | ⋮ | ⋮ | ⋮ | ⋮ | ⋮ | ⋮ |

48 50

Fig. 20.

| R | HOSPITALS | | | | | | |
|---|---|---|---|---|---|---|---|
| 1 | Superintendent | F9 | O15 | E7 | E9 | T9 | O12 |
| 2 | Administrator | S3 | W7 | F7 | R1 | O17 | E20 |
| 3 | Department Chief | D6 | L2 | D11 | E10 | R4 | R5 |
| 4 | Physician (Specialist) | D11 | N1 | L3 | W13 | E19 | R5 |
| 5 | Physician (House-staff) | N2 | R3 | R4 | W7 | W8 | E20 |
| 6 | Pharmacist | R2 | N3 | I7 | W8 | N10 | W12 |
| 7 | Registered Nurse | N3 | W8 | I7 | N6 | G12 | O18 |
| 8 | Other Therapists | N3 | D15 | D17 | F13 | I9 | I10 |
| 9 | Clinical Technologists | N3 | F13 | E19 | U17 | U14 | N16 |
| 10 | Technician | V11 | U10 | R9 | R8 | R11 | R12 |
| 11 | Medical Assistant | R10 | N15 | U14 | U15 | V13 | T13 |
| 12 | Clerical Staff | U14 | L8 | P21 | L9 | B3 | V13 |
| 13 | Orderly | R11 | R12 | V12 | T12 | B4 | W12 |
| 14 | Security Guard | F15 | S15 | M20 | P22 | B4 | B5 |

Fig. 21.

| S | STATE GOVERNMENT | | | | | | |
|---|---|---|---|---|---|---|---|
| 1 | Governor | W2 | W13 | W9 | I1 | W3 | RETIRE |
| 2 | Lieutenant Governor | D3 | H7 | P6 | D6 | M16 | L4 |
| 3 | Secretary of the State | F9 | P15 | U7 | E15 | L5 | D17 |
| 4 | Attorney General | G4 | O8 | O10 | G8 | M8 | S5 |
| 5 | Counsel | M16 | N2 | O6 | E17 | N6 | V8 |
| 6 | President of the Senate | W6 | W4 | H2 | I3 | H5 | O10 |
| 7 | Senator | S6 | D4 | V5 | T5 | G6 | I7 |
| 8 | Speaker of the Assembly | W5 | P1 | O1 | V1 | U3 | V4 |
| 9 | Assemblyman | S8 | W7 | P2 | U7 | G6 | I4 |
| 10 | Comptroller | E3 | Q7 | E8 | J1 | V7 | S11 |
| 11 | Deputy Comptroller | M13 | E11 | E13 | T10 | E20 | W11 |
| 12 | Director | P18 | O6 | S3 | W13 | N4 | G11 |
| 13 | Deputy Director | O12 | S12 | U9 | N5 | P21 | N10 |
| 14 | Senior Staff | N4 | F14 | J5 | J7 | H16 | D19 |
| 15 | Junior Staff | N7 | E21 | J7 | J8 | V13 | T13 |
| 16 | Security Guard | D19 | T12 | F15 | J10 | B4 | W12 |

Fig. 22.

| T | NEWS MEDIA | | | | | | |
|---|---|---|---|---|---|---|---|
| 1 | Chairman | W2 | W13 | W10 | I2 | L1 | RETIRE |
| 2 | Vice Chairman | W6 | E1 | B1 | Q4 | L3 | T4 |
| 3 | President | L1 | G2 | W6 | T2 | V5 | T7 |
| 4 | Vice President | T3 | I3 | D8 | M10 | R1 | T8 |
| 5 | Department Director | V2 | T4 | T7 | H10 | U17 | T9 |
| 6 | Division Chief | T5 | E11 | D13 | W13 | V8 | N12 |
| 7 | Chief Editor | T3 | H7 | W10 | P6 | T8 | E13 |
| 8 | Assistant Editor | T7 | V5 | T4 | N2 | R2 | W8 |
| 9 | Columnist | E18 | D10 | W10 | M6 | V9 | V11 |
| 10 | Journalist | D13 | M7 | W10 | F10 | M19 | D18 |
| 11 | Photograper | W8 | L6 | W10 | U17 | N7 | W12 |
| 12 | General Staff | E21 | I9 | S14 | M20 | V13 | T13 |
| 13 | Security Guard | D19 | V12 | T12 | I10 | B4 | B5 |

Fig. 23.

| U | UNION | | | | | | |
|---|---|---|---|---|---|---|---|
| 1 | American Federation of Labor, President | W2 | W13 | W10 | I1 | W6 | RETIRE |
| 2 | Vice President | W4 | W6 | W5 | T3 | U3 | RETIRE |
| 3 | Secretary-treasurer | U2 | H8 | V1 | D6 | T8 | W11 |
| 4 | Congress of Industrial Organization, President | W3 | O1 | E1 | O2 | H11 | RETIRE |
| 5 | Vice President | U4 | U2 | U6 | V5 | E15 | W12 |
| 6 | National Union, President | W3 | W6 | W4 | W5 | U3 | RETIRE |
| 7 | Vice President | U6 | U2 | U4 | D7 | E14 | W8 |
| 8 | Secretary-treasurer | U7 | U11 | E8 | F10 | M18 | W11 |
| 9 | Department Director | U8 | U12 | V6 | W7 | P20 | N12 |
| 10 | Deputy Director | U9 | L5 | J3 | J5 | J7 | B1 |
| 11 | State Federation, Chief | U6 | U4 | P5 | U7 | U12 | V4 |
| 12 | City Center, Chief | U5 | V3 | U7 | V6 | U13 | P17 |
| 13 | Local Union, Steward | U12 | T5 | U8 | J2 | M19 | N12 |
| 14 | Senior Staff | U10 | E20 | O17 | R10 | B2 | B3 |
| 15 | Junior Staff | U14 | L8 | E21 | W13 | B3 | B4 |
| 16 | Security Guard | P22 | F15 | R12 | J10 | K16 | B5 |
| 17 | Regal Counsel | E15 | G8 | E12 | W7 | G11 | F14 |

Fig. 24.

| V | SHOW BUSINESS | | | | | | |
|---|---|---|---|---|---|---|---|
| 1 | Chairman | E1 | W6 | W4 | W5 | L2 | E9 |
| 2 | Vice Chairman | E2 | Q2 | Q18 | L2 | G6 | U8 |
| 3 | President | V1 | Q18 | D3 | M15 | T5 | V6 |
| 4 | Vice President | V2 | V3 | E6 | E7 | W7 | E19 |
| 5 | Producer | P5 | H8 | W10 | W13 | F10 | D16 |
| 6 | Director | V2 | V3 | W10 | H9 | V7 | T6 |
| 7 | Actor, Actress | V6 | W7 | W10 | L4 | W8 | V8 |
| 8 | Supporting Actor, Actress | V7 | V10 | W10 | W8 | N7 | W12 |
| 9 | Scriptwriter | L5 | W8 | W10 | T6 | G12 | P21 |
| 10 | Assistant Director | V4 | G5 | O9 | E5 | W7 | W8 |
| 11 | Photographer | U13 | V10 | W10 | T10 | L8 | E21 |
| 12 | General Staff | N8 | I9 | N15 | P21 | S16 | I11 |
| 13 | Security Guard | H16 | V12 | P22 | E22 | B4 | B5 |

Fig. 25.

W ELECTIONS, AWARDS & PUNISHMENTS

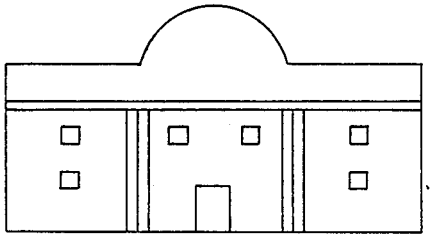

| | | | | | | | |
|---|---|---|---|---|---|---|---|
| 1 | Presidential Election ---- Votes | 30 | 20 | 10 | 5 | 2 | 0 |
| 2 | Presidential Candidate --- Nomination | W1 | W1 | W1 | STAY | LOSE | LOSE |
| 3 | Vice President - Election | M1 | M1 | M1 | STAY | LOSE | LOSE |
| 4 | Senatorial Election | M5 | M5 | M5 | STAY | LOSE | LOSE |
| 5 | House Representative Election | F6 | F6 | F6 | STAY | LOSE | LOSE |
| 6 | Governor of State Election | S1 | S1 | S1 | STAY | LOSE | LOSE |
| 7 | State Government Senatorial Election | S7 | S7 | S7 | STAY | LOSE | LOSE |
| 8 | State Government Assemblyman Election | S9 | S9 | S9 | STAY | LOSE | LOSE |
| 9 | Promotion | 3 | 2 2 | 3 | 2 2 | 2 2 | 3 |
| 10 | Awards & Prize - Chips | 30 | 20 | 10 | 8 | 6 | 4 |
| 11 | Punishment * Pay chips for fine | ACQU-ITMD | ACQU-ITMD | FINE * 10 | FINE * 20 | FINE * 30 | OUT |
| 12 | Traffic Violation Fine --- chips | EXEM-PTED | 3 | 5 | 8 | 10 | 20 |
| 13 | Happy Birthday | GET 5 CHIPS FROM EACH PLAYER | | | | | |

48 50

BOARD GAME

BACKGROUND OF THE INVENTION

1. Field of the Invention

The present invention relates to games and more particularly a board game in which the players strive to become President of the United States by accumulating the necessary quantity of electoral votes.

2. Description of the Prior Art

Board games used to simulate election campaigns have been previously proposed in a variety of different forms with a variety of different rules. For instance, U.S. Pat. Nos. 1,907,255 and 4,299,390 feature electoral board games which involve the accumulation of electoral votes to become President of the United States.

Additionally, somewhat related board games which involve a player striving to become president of a business or major stock holder of a corporation are also known in the prior art. For example, U.S. Pat. Nos. 1,536,672 and 4,095,799 illustrate games of this sort.

None of these patents, however, achieve the scope of the present invention or the excitement the present invention creates in covering the entire life of one attempting to become President.

PURPOSE OF THE PRESENT INVENTION

A primary purpose of the present invention is to provide an exciting and entertaining game, which will, in addition, impart educative values relative to the electoral process in the United States.

Another educative purpose of the invention is the emphasis of the type and multitude of positions available in certain categories of society in the United States.

An additional object and purpose of the invention is to introduce into such a game an appreciation of a part chance can play in determining one's position in life while at the same time illustrating how hard work can often improve one's chances.

SUMMARY OF THE INVENTION

The present invention is provided to achieve, among other, the above stated purposes and objects.

To achieve these purposes and objects the invention comprises a rectangular game board divided into a plurality of designated sections. In addition to the designated sections, the game board includes representation sections preferably positioned along the bottom edge of the game board. In a preferred embodiment of the invention the designated sections and representation sections are arranged in columns; yet, alternate arrangements are also possible. Additionally, each representation section features illustrations of the faces of a die arranged in a chosen sequence from left to right. It would also be possible to use other chance means such as a spinning arrow on an indicator board whereby the indications on the board are depicted in the representation sections of the game board.

The designation section can be designated by letters of the alphabet with each lettered section representing one of a variety of categories such as show business, news media, education, etc. Within each of these categories are a plurality of subsets which depict topics relevant to the topic of the category. For instance, senior high school, junior high school and the like, are contained within the education category.

The subsets can be arranged so that the top positioned subsets within each category represent positions more favorable than those towards the lower positions. However, for the purposes of this invention this is not essential and, in any event, subjective determination of the status of a position often can prove to be incorrect.

Each of the subsets within a section is identified by a symbol such as a number, and titles for each subset are preferably set forth along the left side edge of each section. To the right of each subset, preferably, are six space indicators consisting of a first symbol (i.e., letter) and a second symbol (i.e., number) with the first symbol representing a section and the second symbol representing a subset contained within the section represented by the first symbol. The indicators are arranged within each subset so that the six die faces, preferably arranged at the bottom of each column, are aligned with a respective one of the six space indicators.

In a preferred embodiment, game equipment also includes four dice, two playing pieces or markers per player and play money.

To move one of the playing pieces a player must throw at least a pair of dice. Upon throwing the dice, the player determines the space indicator within the subset the player's playing piece is located, which lines up with the die face representation for the dice pair thrown. Some of the space indicators direct the player to move to a new subset in a different area of the board, some indicate that the playing piece is to stay in the same position, and others give different directions which will be explained more fully hereinafter.

The six die faces within each of the die face representation sections are arranged in any sequence desired. In a preferred embodiment of the invention the die faces have different degrees of desirability to a player. That is, it is more desirable for a player to roll a die face to the left of the six die face sequence than one towards the right. This is due to the arrangement of the space indicators within each subset. The space indicators to the left of the six space indicators within each subset give more desirable results those to the right of the sequence. For instance, if one were to obtain a pair of 4's when rolling and the die face for 4 in the die face sequence is the one furthest to the left, the space indicator might allow the player to make a big advancement in the game. On the other hand, if a player, were to roll a pair that was represented on the right of the die face sequence the player might be subject to a backward movement in the game.

This game also involves a "special" section which for purposes of this discussion will be represented by the letter "W". If the player's throw of dice results in a space indicator which includes a "W", the second playing piece or marker comes into play. The second game piece is positioned within the "W" section in the appropriate subset denoted by the second symbol of the space indicator while the first playing piece is maintained in the subset containing the space indicator which placed the second playing piece into play.

Upon the player's subsequent throw of the dice, if a pair is obtained the die face representation thereof is used to determine the space indicator in the subset where the second playing piece is located. In some instances, the space indicator within the "W" section will give an indication that the first playing piece will make rapid advancement within the other "non-special" sections or, alternatively, a large backward movement within the "non-special" sections. This advancement or backwards movement is dependent in large part on the positioning of the die face representation within the sequence.

Within the "W" section or "special" section are also various other types of subsets which will be discussed hereinafter. Additionally, there is a subset within section "W" which one must land on before winning the game. This subset features various electoral vote quantities sequenced from left to right within the subset and aligned with respective die face representations.

Once a player is routed to this subset by a space indicator, a player is capable of accumulating electoral votes, based on the players throw of the dice. To win the game a player must accumulate a majority of the 538 electoral votes available or 270 electoral votes.

For added excitement to the game, dollar value chips can be lost or won from a pool which each player contributes to in the beginning of the game. various space indicators are used for determining when a player is to lose or gain dollar value chips.

BRIEF DESCRIPTION OF THE DRAWINGS

FIGS. 4–25 shows the text which is printed in the lettered sections of FIG. 1.

DESCRIPTION OF THE PREFERRED EMBODIMENT

Figure 1:
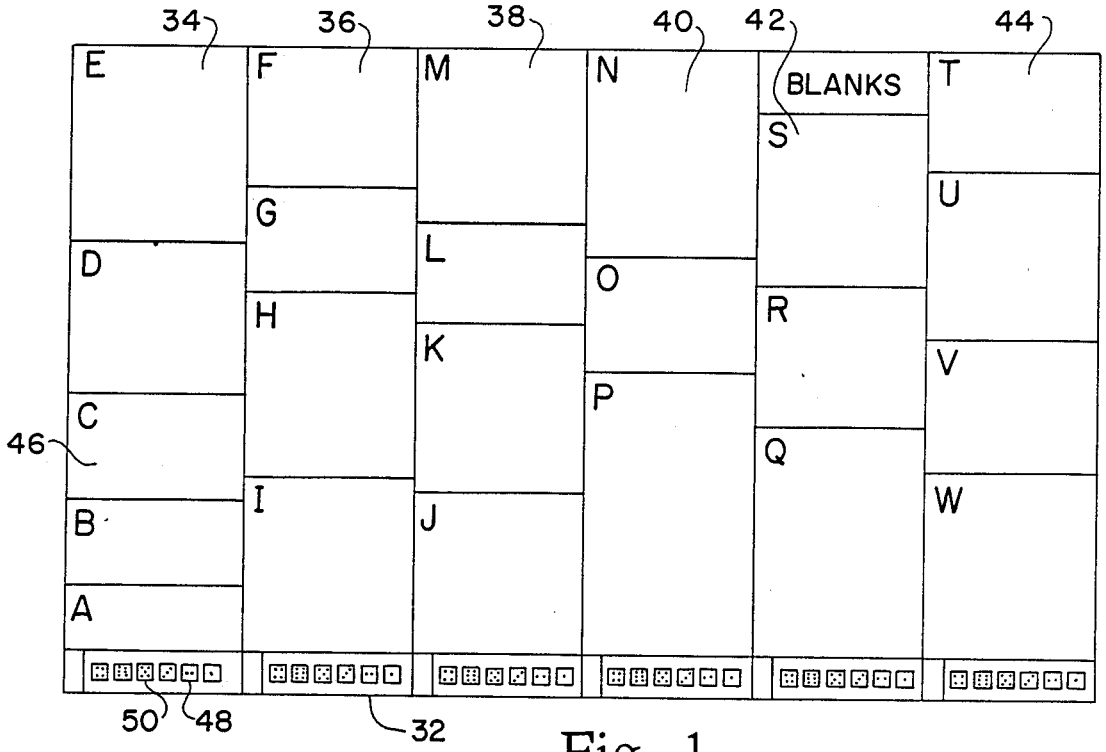
FIG. 1 is a diagram of the playing surface of a game board in accordance with the present invention.

Referring now to the drawings, there is shown in FIG. 1, the playing surface of game board 32. Indicia on the playing surface of the game board divides the playing surface into a plurality of columns 34, 36, 38, 40, 42 and 44. Each of these columns is further broken down into a plurality of sections of varying size. For example, section 46 is in column 34.

A plurality of the sections are designated by way of a symbol contained within the boundary lines defining the section. For instance, section 46 is designated by the letter C.

Additionally, a plurality of the sections 48 are positioned along the bottom edge of each column as shown in FIG. 1 and more clearly in FIG. 4. Within each of these sections 48, there are die face representations 50. Die face representations 50 are shown in FIG. 1 to represent each of the six faces of a die in a specific sequence. It should be noted that the sequence shown in the FIGS. 1, 4, 11, 12, 19 and 25 are exemplary and it is possible to vary the sequence in one or all of the FIGS. 1, 4, 11, 12, 19 and 25. Further, it would be possible to vary the position of the sections 48 within each column and the number of die face representations 50 within each of the sections 48.

FIG. 4 shows a section 52 which is designated by the letter B in its upper left hand corner. In addition, the sections A through W are each given a title such as EDUCATION for section 52, JUDICIAL BRANCH for section 90, FIG. 9 etc. These titles are merely representative of some of the great variety of titles possible which will achieve the contemplated purpose of the present invention.

Referring again to FIG. 4, there is shown a plurality of subsets each arranged as one line which has a representative number and title. For instance, a subset in section B for EDUCATION includes "Kindergarten" which has a subset number of "8". Furthermore, section B for EDUCATION includes a subset entitled "ph.D." having a subset number of "1".

For the most part it can be seen that the higher status positions within each section is represented by low numbers while the higher numbers represent lower status positions. This is not true for all sections, however, as illustrated in section H in FIG. 10 which places "Ambassador" below the "Security Guard" position. This is done to add an element of excitement to the game by allowing one to make a recovery from what usually would be a bad roll of the dice. Also, in some areas the subjective determination of status would not always prove true.

With regard to FIG. 6 there is shown section D entitled "The White House Office". To the right of the subset labels are positioned six space indicators 54. Each space indicator for this section includes a letter/number combination with the letter representing a specific section of the board and the number representing a specific subset within that section.

Figure 2:
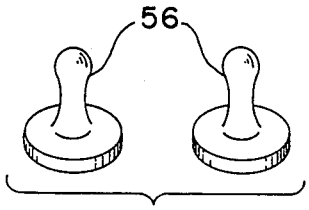
FIG. 2 illustrates playing pieces.

In FIG. 2, two playing pieces 56 are shown. Each player is to receive two of these playing pieces which have the same distinguishing color or shape.

Figure 3:
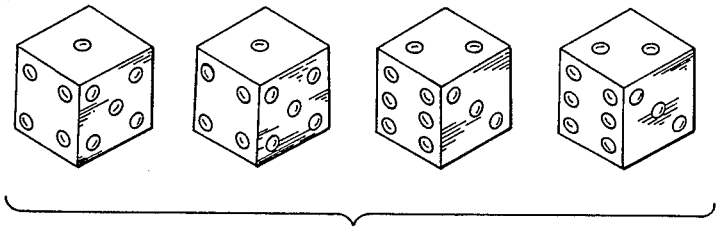
FIG. 3 illustrates conventional dice or chance members.

In FIG. 3, four dice are illustrated. Each player rolls all four dice each turn.

Figure 26:
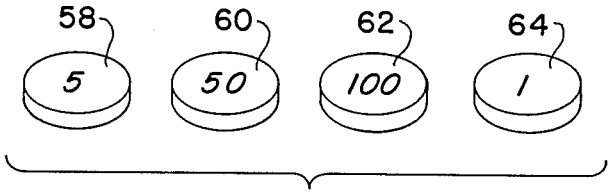
FIG. 26 illustrates value chips.

FIG. 26, illustrates the dollar chips to be used in the present invention 58 designates a five dollar piece, chip 60 a fifty dollar piece, and chip 62 a one hundred dollar piece. It is noted that other variations are also possible which will suit the purpose of the present invention. For six players a combination of chips totaling three thousand dollars should be sufficient.

FIG. 25 reveals the "special" section "W" of the present invention. As shown in FIG. 25, section "W" is in the same basic format of the other "non-special[ sections. There is, however, a distinguishing difference in many of the space indicators shown in section "W" which are not available in the other sections. Of particular importance is subset Wl which contains varying electoral vote quantities. To win, a player must end up in subset Wl and roll a sufficient number of dice combinations to accumulate 270 electoral votes which represents a majority of the 538 electoral votes available.

In playing a preferred embodiment of the game each player is first assigned a pair of playing pieces 56 which are colored so as to distinguish one player from another. In the preferred embodiment of the invention a maximum of six players and twelve playing pieces are contemplated. Nonetheless, if desired, it is possible to increase the number of players and playing pieces.

To start the game each player gets 500 dollars worth of the chips represented in FIG. 26 and chooses a similarly colored pair of playing pieces Each player then places 100 dollars in a common pool and places one of the playing pieces within the "START" or "A" section of FIGS. 1 and 4.

The four dice are then thrown in turn until at least a single matching pair of dice is obtained. With reference to FIG. 4 if the matching pair is a pair of 4's then the player throwing the pair would determine B5 to be the applicable space indicator. The player would then move his playing piece from start section A to subset 5 in Section B which is entitled "Senior High School". On the other hand, were that player to roll a pair of 2's rather than a pair of 4's that player would not advance but would be required to "STAY" in the same position in accordance with the space indicator in section A.

Thus, the advantage of landing on a die face representation to the left of the die face sequence rather than a die face representation to the right of the sequence is illustrated. Or in other words, the sequence of pairs represented by die faces 4, 5, 6, 3, 2, 1 goes from excellent performance on the left (i.e., 4) to poor performance on the right (i.e., 1). This arrangement holds true for each of the six columns illustrated.

For a preferred embodiment of the invention playing pieces are moved along the board according to various combinations of dice rolls and various rules indicated as follows:

a. Single pair of dice—One move as denoted by the space indicator which aligns with the die face representation for the pair of dice rolled.
b. Two pair of dice—Two moves, starting with the pair having a die face representation furthest to the left.
c. Three of a kind—Two moves using the die face representations of the triplicate dice.
d. Four 4's—Move four times using the die representation for 4's.
e. Four of a Kind (1,2,3,5 or 6's)—Move two times using the die face representation for 4's.
f. High Straight (3,4,5 & 6)—Pick up 5 dollars worth of chips from the pool or a bonus.
g. Low Straight (1,2,3 & 4)—Put 5 dollar worth of chips in the pool for contribution to the election campaign
h. Any pair of 1's or 2's which are accompanied by one or two 4's will be exempted from movement.
i. "RETIRE" as in FIG. 23 is an indication either to get 50 dollars worth of chips from the pool and quit the present game or to reinvest 10 dollars worth of chips to the pool and continue playing.
j. "OUT" as in subset 11 section W (FIG. 25) is an indication which requires the player to drop from the game in progress.
k. If all players, except for one, drop out of a game in progress then that one remaining collects all the dollar chips in the pool and the game is restarted.
l. If while in subset 2 section W (FIG. 25) a player is nominated for president and directed to move to subset 1 of section W then that player obtains 50 dollars worth of chips from the pool.
m. Once a player is in subset 1 of section W then the player is able to accumulate electoral votes. To win the game a player must get 270 electoral votes of the possible 538 electoral votes.
n. A player who is able to accumulate 270 votes is elected President of the United States and wins all the dollar chips in the pool.
o. If all 538 possible electoral votes are accumulated by the players but no one player is able to get a majority of 270 votes then the top two vote accumulators must compete with each other alone in the accumulation of points.

To illustrate some of the rules above, the following examples are given:

If a player having a playing piece in subset 18 of Section E (FIG. 7) were to roll three 6's and a 2 that player would determine Q7 (FIG. 19) to be the next playing piece location. Thereafter, in accordance with rule (c) above the player would move the playing piece from Q7 (FIG. 19) to U2 (FIG. 23) where it would remain until the player's turn to roll came up again. It should be noted that after each move the playing piece is positioned to the left of the space indicators so as to cover the title of the appropriate subset not the space indicators. Thus, upon the player's next roll, visual inspection to determine which space indicator is applicable is made easier.

If the player, on the next turn, were to roll a pair of 5's and a 1 and 2 then the player would determine W5 in subset 2 of section U to be the next space indicator. However, since "W" represents the "special" section, the player brings the second playing piece into play and, for the moment, leaves the first playing piece in subset 2 of section U.

The player would place his second playing piece in subset 5 of section W (FIG. 25) and await his next turn to roll the dice. If on the next turn the player were to roll a pair of 6's and a pair of 5's then the player would determine space indicator F6 to be aligned with the die face representation for the pair of 6's. Thereafter the player would move the first playing piece from U2 to F6 (FIG. 8). Then in accordance with rule b above the player would align the die face representation 5 with the space indicators in F6 to determine F3 (FIG. 8) to be the next location of the playing piece. After so moving the first playing piece, the second playing piece is withdrawn from section W until the first playing piece again lands on a space indicator for the W section.

Referring again to FIG. 25, it is noted that there are various type of subsets within the W section which differ from the subsets contained in the other lettered sections. Subsets 2–8 in the "W"p0 section have contained therein space indicators "STAY" and "LOSE". The "STAY" indicators, if landed on, allow the player to keep the second playing piece within the W section rather than removing it. Thus, on the player's next turn the player would roll to determine which space indicator in the W section governed.

On the other hand, the "LOSE" space indicator indicates that the player has to withdraw the second playing piece from the W section and maintain the first playing piece in the same position until the player's turn comes up again.

Subset 9 of section W, the "Promotion" subset, contains various combinations of die face representations. A player landing on one of the space indicators moves the first playing piece from its position in the "non-special" section to a new position in accordance with the die face or faces represented by the space indicators. For example, if a player, having the first piece at I5 (FIG. 11) in the "non-special" section and the second piece at W9 in the "special section" were to roll a pair of 6's, then that player would move the first piece from I5 to I3 and then put the second piece to W5 in accordance with the die face representations shown in the space indicater in W9, and then the next player would roll.

In W10 the player is assured of receiving a certain value of dollar chips from the pool. After receiving these chips, the player would remove the second piece from the section and continue playing with the first piece.

A player ending up in W11 will be either subject to a fine, "ACQUITTED" or determined to be "OUT" of the game. If the player is "ACQUITTED" then no fines are paid and the second playing piece is removed from the W section. Likewise, after paying the indicated fine to the pool the player removes the second playing piece from the W section. If determined "OUT" of the game the player moves both the first and second pieces from the board and discontinues play.

Subset W12 is much like Wll except there is no "OUT" indication and the player is "EXEMPTED"

from paying the traffic fine rather than "ACQUITTED."

After landing in W13, the player receives 5 dollars worth of chips from each player, and the player removes the second playing piece from the W section.

Four players playing in the manner described above would normally take 30 minutes to 1 hour to complete a game. If it is desired to shorten the time it is possible to make a number of variations in the board, space indicators, rules or the like to achieve such a result.

Further it will be understood that modifications, within the scope of the appended claims, may be made in the design and arrangement of the components of the board game without departing from the spirit of the invention.

What is claimed is:

1. A game, comprising:

a plurality of playing pieces;

chance means for providing random indications while playing the game;

a game board having a playing surface;

indicia on said playing surface dividing said playing surface into sections, said indicia also dividing each of a first plurality of said sections into a plurality of subsets, said sections having noted therein a series of chance means representations which correspond with the indications of said chance means, said subsets having noted therein a plurality of space indicators which are separate and distinct from said chance means representations, a plurality of the space indicators comprising a first symbol which represents one of said first plurality of sections to which a playing piece may move and a second symbol representing one of the subsets to which a playing piece may move, a plurality of said space indicators located in series within each of said subsets, and each space indicator being aligned with one of the chance means representations;

such that a player utilizing said chance means determines the space indicator applicable by observing which space indicator, within the subset where the playing piece is located, is aligned with the chance means representation that corresponds with the indication of the chance means.

2. A game according to claim 1, wherein said first symbols are letters and said second symbols are numbers.

3. A game according to claim 2 where a plurality of said sections are lettered sections in the respect that they each have an identifying letter which distinguishes them from other lettered sections, said lettered sections each having a title representing specific and distinct categories, each of the subsets within each of the lettered sections including notations which are subdivisions of the category of the lettered section which contains said subset.

4. A game according to claim 3 wherein, in each section, the notations for the numbered subsets indicate generally higher status positions in life for lower numbered subsets and lower status positions in life for the higher numbered subsets.

5. A game according to claim 1 wherein said chance means representations are contained within a section which is positioned along a lower edge of the playing surface.

6. A game according to claim 1 having pairs of said playing pieces, with each playing piece of a pair of playing pieces being essentially visibly the same and each pair of playing pieces being distinguishable from other pairs of playing pieces.

7. A game according to claim 6 wherein one of said sections of said game board is for sole use with a first playing piece within each pair, and other sections of said game board are for sole use with a second playing piece within each pair.

8. A game according to claim 1 wherein said chance means include a plurality of dice members.

9. A game, comprising:

at least a pair of game pieces per player;

a game board having a playing surface;

chance means;

means defining a first section having associated therewith indication means for sole use with a first one of said game pieces of said pair;

means defining at least one second section, said second section having associated therewith designation means for sole use with a second one of said game pieces of said pair, said designation means including first section space designation means for designating that said first playing piece is to be utilized within said first section;

said indication means including second section indication means for indicating the position said second playing piece is to assume within said second section;

means defining a plurality of subsets within said first and second sections, said designation means arranged in series within the means defining the subsets in said second section, and said indication means arranged in series within said means defining the subsets in said first section;

means defining chance means representation sections with each chance means representation section including a series of chance means representations, said chance means representations arranged in alignment with said indication means in said first section and in alignment with the designation means in said second section.

10. A game according to claim 9, wherein said chance means representation sections are positioned along a lower edge of the playing surface beneath the means defining said first and second sections, one of said chance means representation sections having a series of chance means representations arranged in alignment with an equal number of indication means within the subsets of the first section, and a series of chance means representations arranged in alignment with an equal number of designating means within the subsets of the second section.

11. A game according to claim 10, wherein said means defining the first section and said means defining a second section are individually lettered and each of the subsets within each section is individually numbered.

12. A game according to claim 11, wherein a plurality of said indication means include a letter which corresponds to a said individually lettered section, said indication means also including a number which corresponds to a said individually numbered subset, thus enabling a player who utilizes said chance means to determine the section and subset to which a game piece may be moved.

13. A game according to claim 12, further comprising a plurality of monetary value chips and a plurality of said indicating means being adapted to indicate the loss or gain of said dollar chips by a player.

14. A game, comprising:

a game board;

playing pieces with at least a pair of playing pieces per player;

means defining sections on said game board;

means defining subsets within a first plurality of said sections;

first symbol means for representing each of the first plurality of said sections second symbol means for representing each of the subsets within the first plurality of said sections;

a plurality of space indicator means for determining movement of said playing pieces, each of said plurality of space indicator means comprising one of said first symbols and one of said second symbols, a plurality of said space indicator means located within each of a plurality of said subsets;

chance means representations which are separate and distinct from said space indicator means and located in a second plurality of said sections, and each of said space indicator means being in alignment with one of said chance means representations;

third symbol means separate and distinct from said first and second symbol means and positioned in a single one of said first plurality of sections, said space indicator means positioned in said single section as well as in other sections of the first plurality of said sections, and said single section which contains said third symbol means being adapted for sole use with a first of each of said pairs of playing pieces and the remainder of said first plurality of sections being adapted for sole use with a second playing piece of each of said pairs of game pieces.

15. A game according to claim 14 wherein said third symbol means includes a plurality of electoral vote accumulation means contained within one subset of said single section.

* * * * *

UNITED STATES PATENT AND TRADEMARK OFFICE

CERTIFICATE OF CORRECTION

PATENT NO. : 4,865,327

DATED : September 12, 1989

INVENTOR(S) : Kuo-Yi Wang

It is certified that error appears in the above-identified patent and that said Letters Patent is hereby corrected as shown below:

On the cover sheet, in the far right column, third row down of the lower figure entitled "EDUCATION", delete "B3" and replace it with --B4--.

IN THE DRAWINGS:

FIG. 4, in the far right column, third row down, delete "B3" and replace it with --B4--.

FIG. 9, in the fourth row, delete "Judge, District Count" and replace it with --Judge, District Court--.

FIG. 17, delete the heading "SCHOOL FACULTIES" and replace it with --DEPARTMENT OF JUSTICE--.

UNITED STATES PATENT AND TRADEMARK OFFICE

CERTIFICATE OF CORRECTION

PATENT NO. : 4,865,327

DATED : September 12, 1989

INVENTOR(S) : Kuo-Yi Wang

It is certified that error appears in the above-identified patent and that said Letters Patent is hereby corrected as shown below:

Fig 25, row 11, delete "ACQU-ITMD" (both occurrences) and replace it with --(ACQU-ITTED)-- (both occurrences).

Signed and Sealed this

Twenty-third Day of October, 1990

*Attest:*

HARRY F. MANBECK, JR.

*Attesting Officer*

*Commissioner of Patents and Trademarks*